United States Patent [19]

Bergeron

[11] Patent Number: 5,036,695

[45] Date of Patent: Aug. 6, 1991

[54] DEVICE FOR STRAIGHTENING VEHICLE FRAME

[76] Inventor: Marcel J. Bergeron, 288, Rang St-Edouard, Iberville, Quebec, Canada, J2X 4J3

[21] Appl. No.: 519,747

[22] Filed: May 7, 1990

[51] Int. Cl.[5] ..... B21D 1/12

[52] U.S. Cl. ..... 72/447; 72/705; 72/704

[58] Field of Search ..... 72/447, 457, 705, 704

[56] References Cited

U.S. PATENT DOCUMENTS 3,340,720 9/1967 Chartier ..... 72/705

3,927,550 12/1975 Samuelsson ..... 72/705

*Primary Examiner*—Lowell A. Larson

*Attorney, Agent, or Firm*—Roland L. Morneau

[57] ABSTRACT

A force applying structure is made to be fixed on the periphery of a frame straightening bench for a vehicle for simultaneously pushing and pulling on a part of the vehicle. The structure includes an upstanding post rigidly fixed in spaced relationship with the straightening bench. A device is mounted on the post for pulling on a chain and pushing with a hydraulic cylinder. The device comprises a base plate vertically fixed on the post and partition plates mounted edgewise on the base plate for forming a horizontal and a vertical channel forming a cross-shape recess. A first hydraulic cylinder is secured in one of the channel parallel to the base plate and has a piston projecting away from the intersection of the channels. At the intersection of the channels adjacent the first cylinder a pair of guide member having a partly circular contour extends inside the channels. Anchor means are provided on the base plate and are adapted to anchor chain which passes over a wheel mounted at the end of the piston of the first cylinder, over one of the guide members and at least one pulley mounted across any one of the channels. A second hydraulic cylinder is removably fixed to extend away from one of the channels. When the second cylinder and the chain are simultaneously pushing and pulling on a part of the vehicle body, or on a vehicle wheel for alignment correction, the desired straightening result is obtained.

7 Claims, 6 Drawing Sheets

DEVICE FOR STRAIGHTENING VEHICLE FRAME

BACKGROUND OF THE INVENTION

1. Field of the Invention

The present application relates to a vehicle straightening structure and particularly to a force applying structure for light work such as wheel alignment corrections.

The force applying structure, according to the invention, is adapted to be fixed on the periphery of a vehicle frame straightening bench to produce a simultaneous pushing and pulling action on a part of the vehicle such as a wheel.

The new structure is a self-contained device mounted on an upstanding post fixed on the periphery of a straightening bench. The device comprises a plurality of elements suitably arranged to support a forwardly projecting hydraulic cylinder which can perform a pushing action and an arrangement of a vertical cylinder combined with guide members and rollers for receiving a chain adapted to produce a pulling action in a direction opposite the above-mentioned pushing action.

2. Prior Art

In U.S. Pat. No. 4,313,335, Leonard Eck describes a vehicle work rack structure which includes a force applying structure mounted thereon. This structure is rather complex and mainly intended for heavy straightening jobs. The work applying structure, according to Eck operates in pair on opposite sides of the vehicle, by pulling with chains in opposite directions. The force applying structure also works in combination with a brake releasing device around the straightening bench.

U.S. Pat. No. 4,607,519, is more specifically directed to a wheel alignment device which necessitates the removal of the wheel. It makes use of a flanged wheel plate which is mounted over the hub of the vehicle wheel. The plate is essentially pulled by means of a hydraulic jack which is located behind the plate. The chain does not operate a pulling action. The plate is mainly pivoted by the hydraulic jack and its installation and removal of the wheel alignment device is long and laborious.

W. W. Smith describes in two U.S. Pat. Nos. 3,050,099 and 3,149,660, various methods and apparatuses for straightening automobile frames. These arrangements require considerable space due to the relationship between the hydraulic rams and the chains which are contemplated to project in a large variety of directions.

SUMMARY OF THE INVENTION

The force applying structure, according to the present invention, is adapted to be fixed on the periphery of a frame straightening bench for a vehicle which will produce a simultaneous pushing and pulling action on a part of the vehicle. The structure includes an upstanding post rigidly fixed in space relationship with the straightening bench and a device mounted on said post for pulling on a chain and abuttingly supporting a hydraulic cylinder. The device comprises a base plate vertically fixed on the post, a first set of two pairs of partition plates spacedly fixed on the base plate for forming a vertical channel and a second set of two pairs of partition plates spacedly fixed on said base plate for forming a horizontal channel. The vertical and the horizontal channels are intersecting each other for forming a cross-shape recess therebetween. A first hydraulic cylinder is secured between one of the pairs of partition plates substantially parallel relative to the base plate. This first cylinder has a piston oriented to project away from the intersection of the channels. At the intersection of the channels, adjacent the first cylinder, a pair of guide members is mounted inside the channels. The guide members display a partly circular contour inside the channels. Anchor means for chains are fixed to partition plates outside the channels. A chain is adapted to be anchored to this anchor means and is adapted to pass over a wheel mounted at the end of the above-mentioned piston, over one of the guide members, and at least one pulley mounted in any one of the channels across a pair of partition plates. A second hydraulic cylinder is removably fixed at one end to one of the vertical or horizontal pairs of partition plates to project forwardly in front of the base plate. The second hydraulic cylinder, while actuated, provides a forward pressure while the first hydraulic cylinder, when moving the chain will provide a pulling action. Accordingly, when the second cylinder and the chain are simultaneously pushing and pulling on a part of a vehicle body, or on a vehicle wheel for an alignment, the desired straightening result may be obtained.

DETAILED DESCRIPTION OF THE INVENTION

Figure 1:
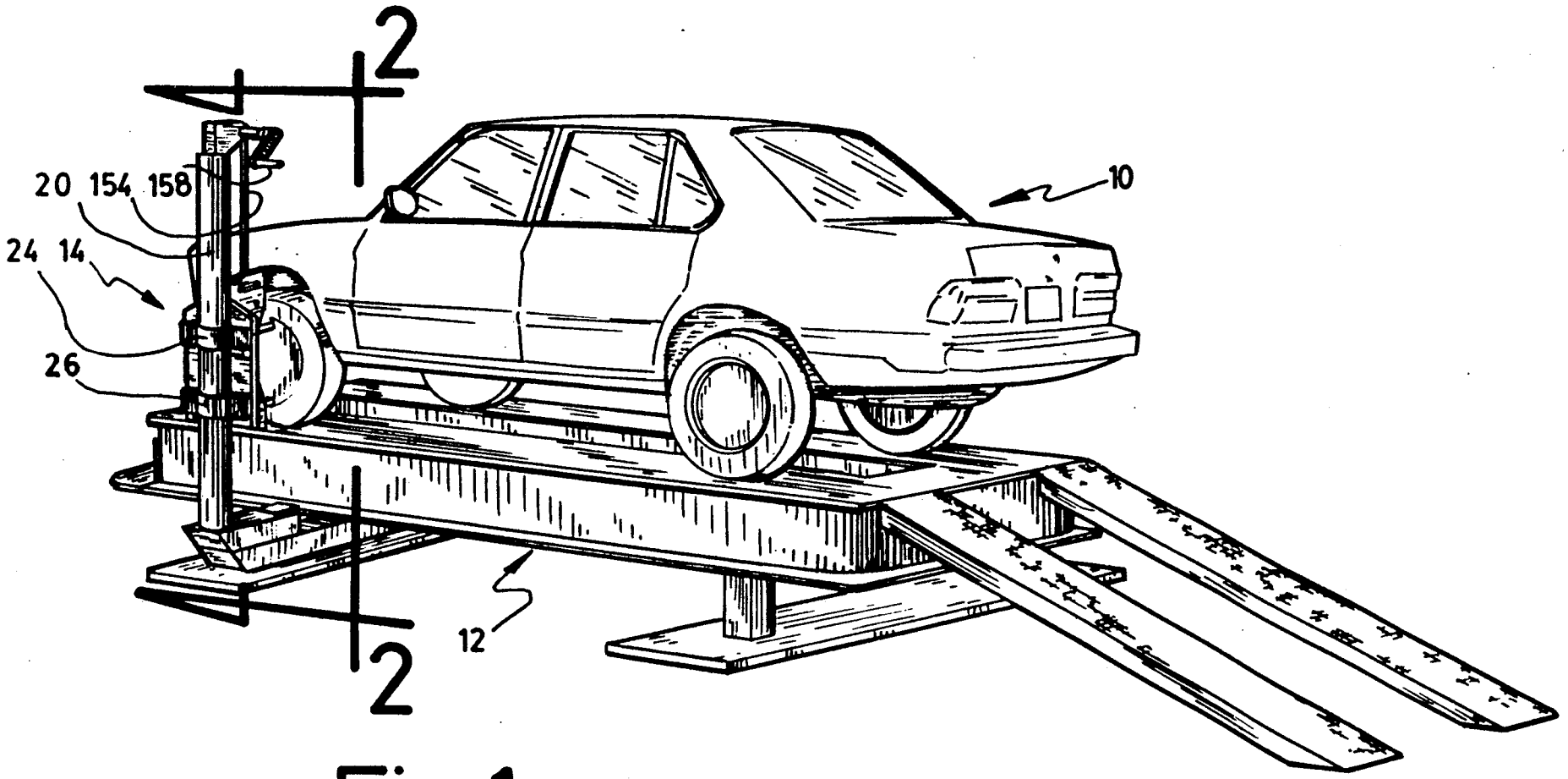
FIG. 1 is a perspective view of a frame straightening bench on which a force applying structure is mounted for a wheel alignment correction.

FIG. 1 illustrates vehicle 10 mounted on a frame straightening bench 12 and around which a force applying structure 14 is installed. The force applying structure 14 is mounted in line with and at the level of the wheel in order to provide a correction following a wheel alignment measurement. The force applying structure 14 can be slidingly displaced around the frame straightening bench 12 so as to be aligned with any of the four wheels or any other part of the vehicle for which a light straightening job needs to be accomplished.

Figure 2:
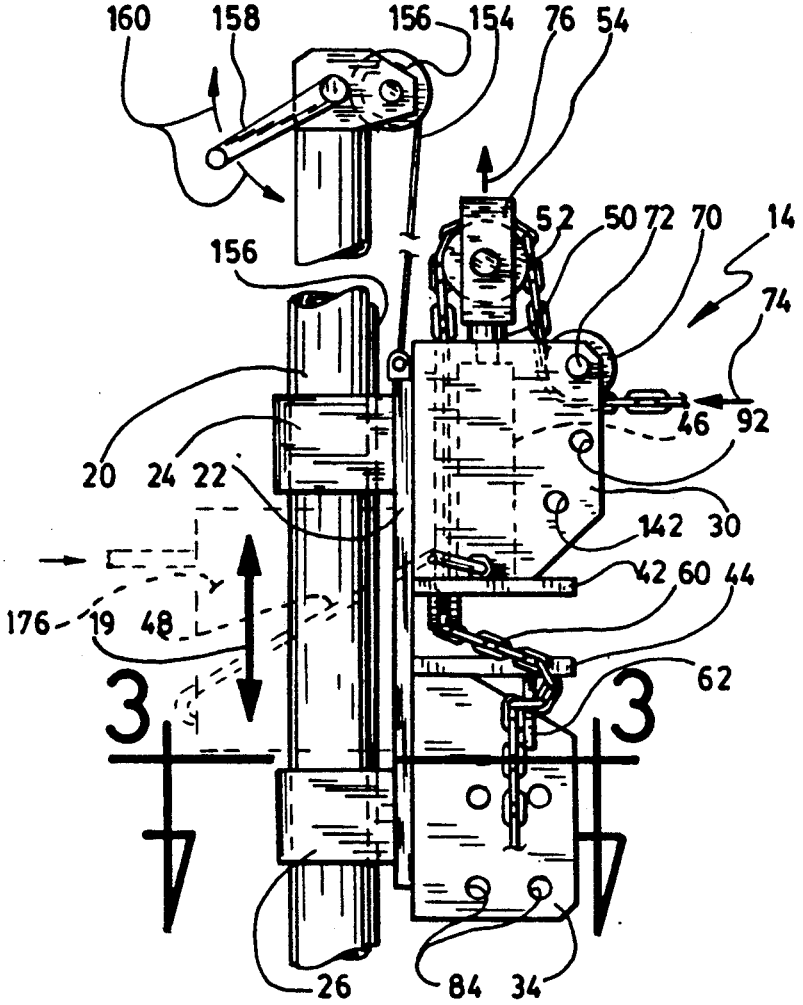
FIG. 2 is a side view of the force applying structure taken along line 2—2 of FIG. 1.
Figure 3:
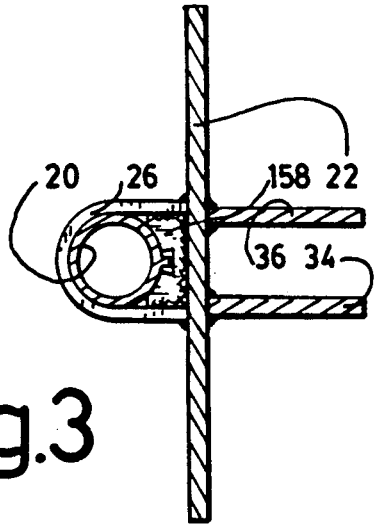
FIG. 3 is a cross-sectional view of the vertically sliding arrangement of the force applying structure on a post.
Figure 5:
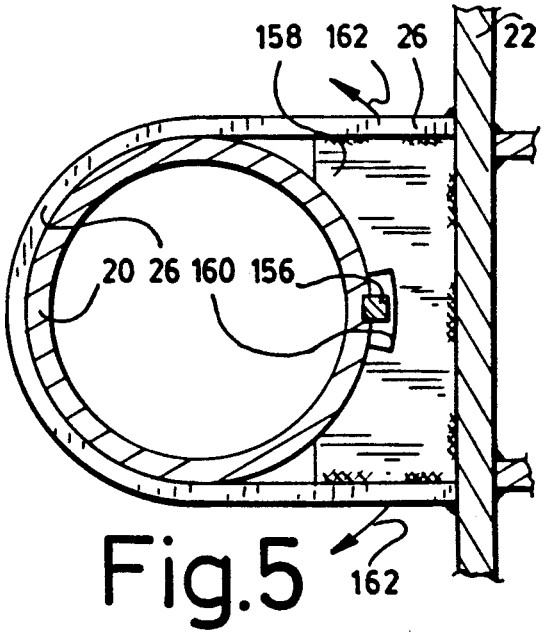
FIG. 5 is an enlarged view of the encircled portion 5 in FIG. 3.

FIG. 2 illustrates a side view of the force applying structure 14 which includes a post 20 along which the core of the structure 14 is arranged to vertically slide in the direction of the arrow 19. A base plate 22 is supported by the post 20 by a pair of U-shaped clamps 24 and 26 secured to the base plate, as shown in FIGS. 2, 3 and 5.

Figure 7:
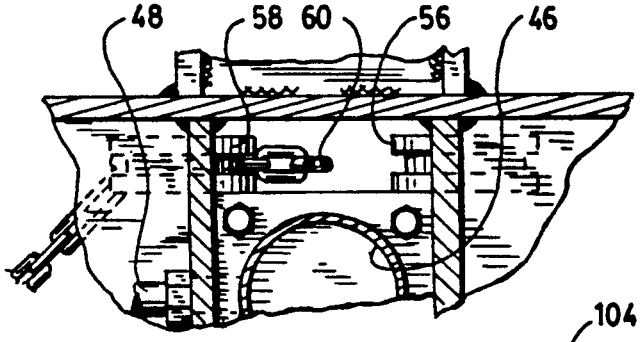
FIG. 7 is a cross-sectional view taken along line 7—7 of FIG. 4.

A first set of pairs of partition plates 30–32, 34–36 form a vertical channel and pairs of partition plates 38–40 and 42–44 form a horizontal channel. All the partition plates 30–44 are welded edgewise to the base plate 22. A hydraulic cylinder 46 is secured in the upper part of the vertical channel 37 and is fed through a fluid line 48. The cylinder 46 has a piston 50 which projects in a direction away from the horizontal channel 45 and in a plane parallel to the base plate 22. A pulley 52 is supported by a bracket 54 at the end of the piston 50 in such a way that the pulley 52 can be moved up and down, relative to the partition plates 30–32. A pair of guide members 56 and 58 having a generally circular contour are secured at the intersection of the vertical and horizontal channels 37 and 45. A portion of the circular periphery of the guide members 56 and 58 extends inside the horizontal and vertical channels adjacent the base of the cylinder 46. The guide members 56 and 58 are peripherally grooved for guiding a sliding of chains 60, such as shown in FIG. 7.

Figure 4:
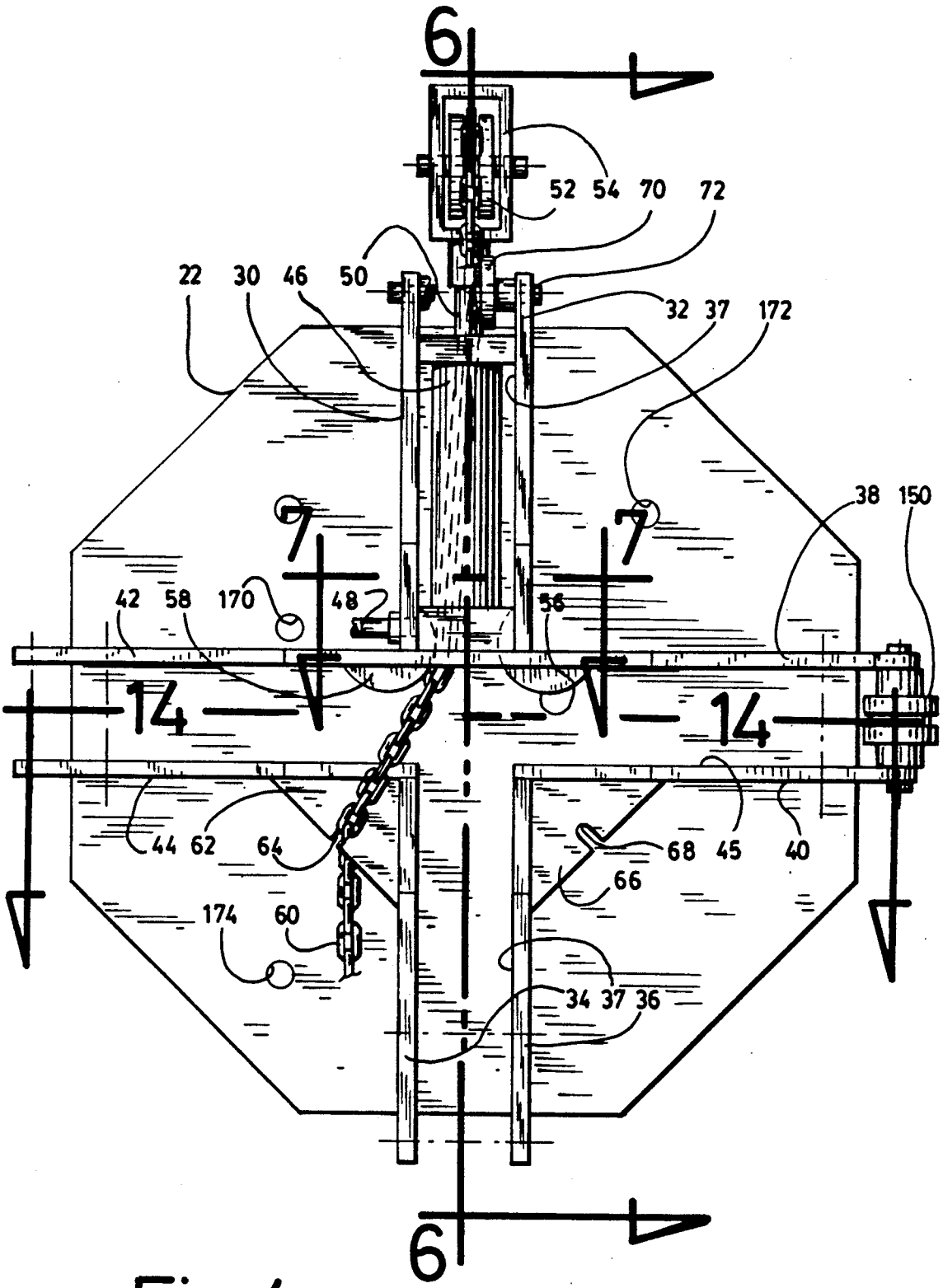
FIG. 4 is a side view of the work applying structure taken along line 4 of FIG. 2.

At the intersection of plates 44 and 34 is welded an anchor plate 62 provided with a notch 64 for hooking the chain 60, as shown in FIG. 4. A similar anchor plate 66 is secured at the intersection of the partition plates 36 and 40 and is also provided with a notch 68 whenever the chain needs to be anchored on the opposite side of the channel 37.

The partition plates 30–44 are provided with perforations so as to allow the installation of pulleys at various locations and for further use, as explained later. A pulley 70 is mounted in perforation 72, as shown in FIGS. 2 and 4, in order to provide a pulling action on chain 60 in the direction of the arrow 74. The chain 60 which is anchored in the notch 64 located in the plate 62, is directed around the guide member 58, passes upwardly behind the cylinder 46 and over the wheel 52 and around the pulley 70. When the cylinder 46 is actuated by the injection of fluid in the fluid line 48, the piston 50 raises in the direction of the arrow 76 (FIG. 2) and automatically pulls on the chain in the direction of the arrow 74.

Figure 6:
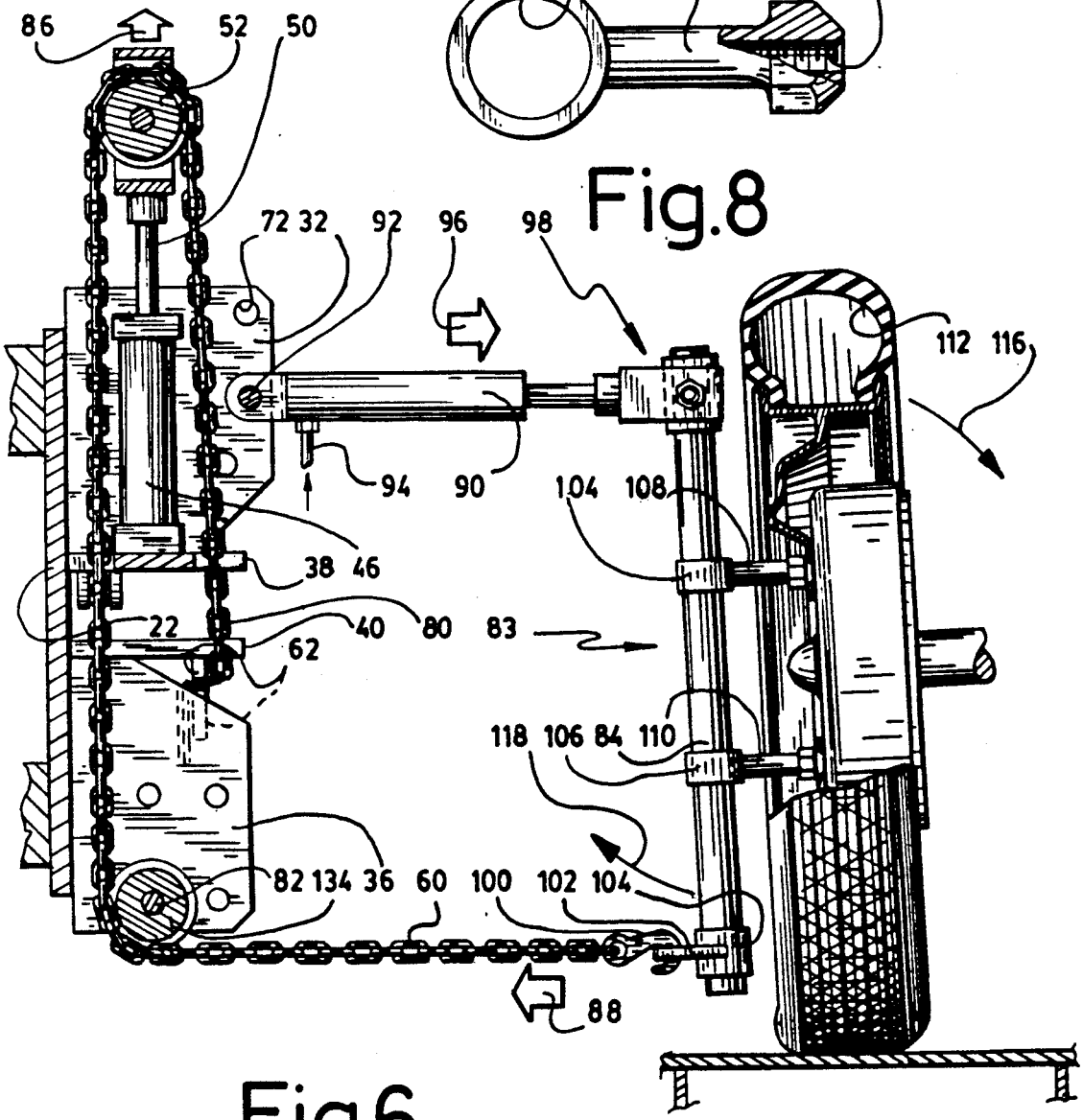
FIG. 6 is a cross-sectional view taken along line 6—6 of FIG. 4.

The force applying structure, as contemplated by the present invention, allows the chain to be pulled along a variety of directions, all generally perpendicular to the base plate 22. In FIG. 6, the chain 80 is anchored on the anchor plate 62 and is directed in front of the cylinder 46 over the wheel 52 and downwardly and around a pulley 82 mounted in perforation 82. In this arrangement, the end of the chain 60 is hooked to a bracket 83 and more specifically to a transversal bar 84. When the piston 50 is actuated to project upwardly in the direction of the arrow 86, the lower end of the chain is pulled in the direction of the arrow 88. In order to compensate for the pulling action by the chain, the force applying structure is provided with a cylinder 90 connected to perforation 92 and oriented in a substantially perpendicular direction relative to the base plate 22. When the hydraulic cylinder 90 is actuated by the injection of a fluid in the fluid line 94, it provides a pushing action in the direction of the arrow 96 at the other end of the transversal bar 84.

Figure 8:
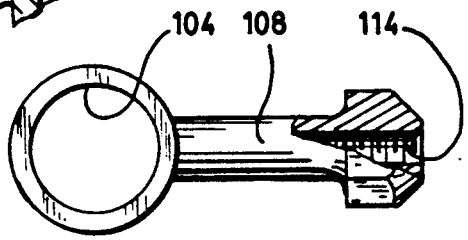
FIG. 8 is a side view of a sleeve abutting member adapted to be threaded on the hub of the vehicle wheel.

In the arrangement shown in FIG. 6, the transversal bar 84 is connected to a vehicle wheel 112 in order to make a mechanical correction following a wheel alignment measurement. The cylinder 90 is connected to the transversal bar 84 at one end through an octogonal sleeve member 98, more specifically illustrated in FIGS. 9 and 10. The chain 60 is connected to the other end of the transversal bar 84 by a hook 100 connected to a perforated plate 102 secured to a sleeve 104. The transversal bar 84 is further provided with a pair of sliding sleeve members 104 and 106 respectfully secured to abutting arms 108 and 110 which are threadedly engaged on conventional hub bolts of a vehicle wheel 112. The sliding sleeve member 104 and the abutting arm 108 are more specifically illustrated in FIG. 8 and is partly cut to show the internally threaded portion 114 which threadedly engages a hub bolt of wheel 112.

The simultaneous actuation of both cylinders 50 and 90, produces opposite pulling and pushing actions on the abutting arms 110 and 108 and forces the wheel 112 to rotate in the direction of the arrows 116 and 118. The selective actuation of both cylinders will produce the desired correction to the wheel.

It should be understood that the force applying structure can be used to produce a combined pushing and pulling action on any part of a vehicle body or frame with suitable connecting brackets.

Figure 13:
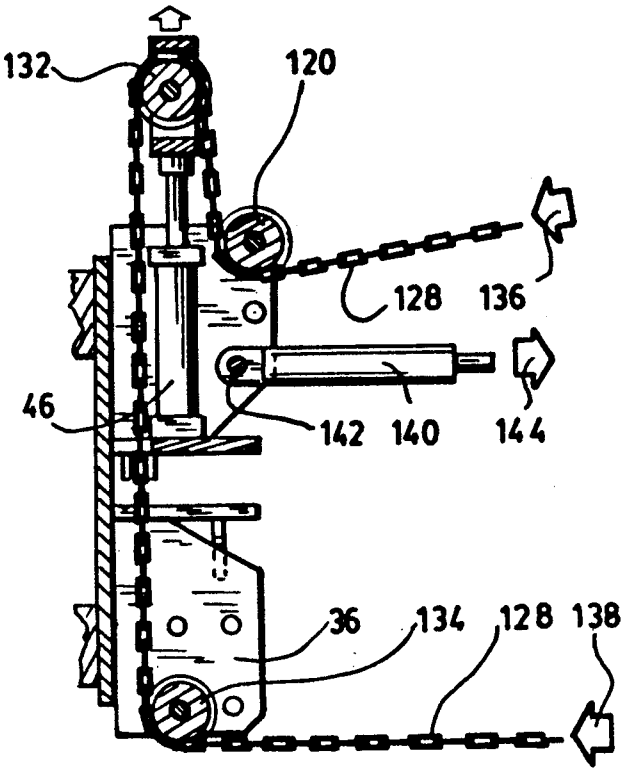
FIGS. 11, 12 and 13 are three side views of alternative embodiments of the force applying structure according to the invention.
Figure 12:
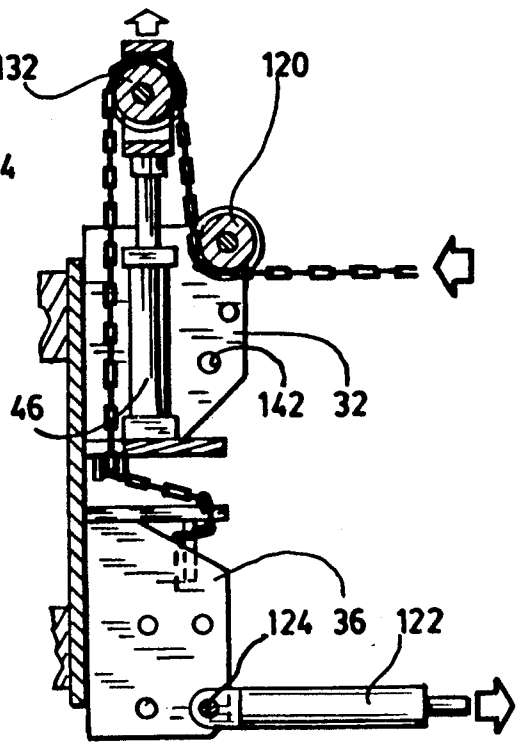
Figure 11:
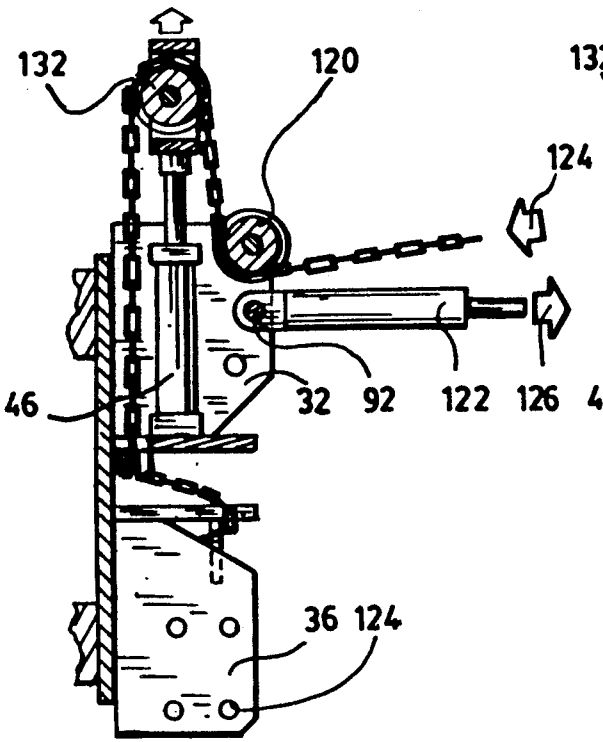

The force applying structure, according to the present invention, allows various directions for applying forces, some of which are also illustrated in FIGS. 11, 12 and 13. In FIG. 11, the pulley 120 is mounted in perforation 72 while the cylinder 122 is connected to the aperture 92. Such a combination is preferred when the pulling direction along the arrow 124 is substantially contiguous with the pushing action in the direction of the arrow 126. In the arrangement shown in FIG. 12, the cylinder 122 is connected to perforation 124. Such an arrangement provides a substantially opposite action to the one illustrated in FIG. 6 in that the pulling takes place above the pushing action when cylinders 46 and 122 are simultaneously actuated. With the present force applying structure, it is further possible to provide a combination of two pulling actions and one pushing action, as illustrated in FIG. 13. The chain 128 is not hooked to an anchor plate but passes around pulleys 130, 132 and 134 so that the projection of the piston 50 produces a simultaneous pulling action at both ends of the chain along arrows 136 and 138. A cylinder 140 connected to perforation 142 provides a pushing action in the direction of the arrow 144 between the two lines of direction of the ends of the chain 128.

It can be seen that the present force applying structure provides a large variety of combinations of arrangements for pulling and pushing on bracket 83, such as shown in FIG. 6 or on some conventional brackets. The partition plates 36 and 32, as well as all the other partition plates mentioned above, can be provided with other perforations suitably located for the desired results depending on the need for locating the direction of the pushing and pulling actions. The same pulley 70, such as shown in FIG. 2, can be transferred to other perforations, such as shown in FIG. 6 by pulley 82 or FIGS. 11 and 12, by pulley 120 and in FIG. 13 by pulley 130. Similarly, the same cylinder 90 shown in FIG. 6 can be connected to different perforations of the partition plates.

Figure 14:
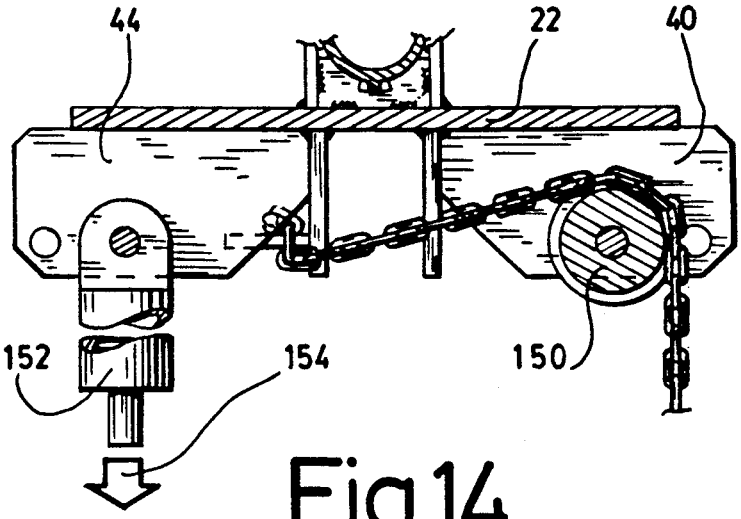
FIG. 14 is a top view of another alternative embodiment of the force applying structure.

The above illustrated arrangements have shown the pulleys and the hydraulic cylinders connected to the vertical partition plates. It is also within the embodiment of the invention to install pulleys in the horizontal channel connected to the horizontally disposed partition plates 38-44, as illustrated in FIG. 14. The pulley 150 shown in FIG. 14 corresponds to the one illustrated in FIG. 4. In the embodiment illustrated in FIG. 14, the chain provides no pulling action per se but is intended to be hooked to a part of the frame while the cylinder 152 will provide a pushing action in the direction of the arrow 154.

The vertical positioning of the force applying structure may be changed by the combination of a cable 154 and a pulley 156 actuated by a handle 158 shown in FIG. 2. The rotation of the handle in the direction of the arrows 160 can lengthen or shorten the cable 154, and accordingly, can produce a sliding action of the base plate 22 on the post 20.

Considering that the force applying structure is not perfectly aligned with the vehicle part to be straightened, a small angular rotation of the base plate is contemplated. For this purpose, the post 20 is provided with a longitudinal key 156 adapted to slide into a grooved plate 158 secured to the brackets 24 and 26 and to the base plate 22. The grooved plate 158 has a groove 160 on its side adjacent the perimeter of the post 20 and the width of the groove is such as to allow an angular rotation shown by the arrows 162 of the base plate 22 of generally less than 30 degrees. The angular rotation of the base plate is limited by the abuttment of the key 156 at both ends of the groove 160.

Figure 9:
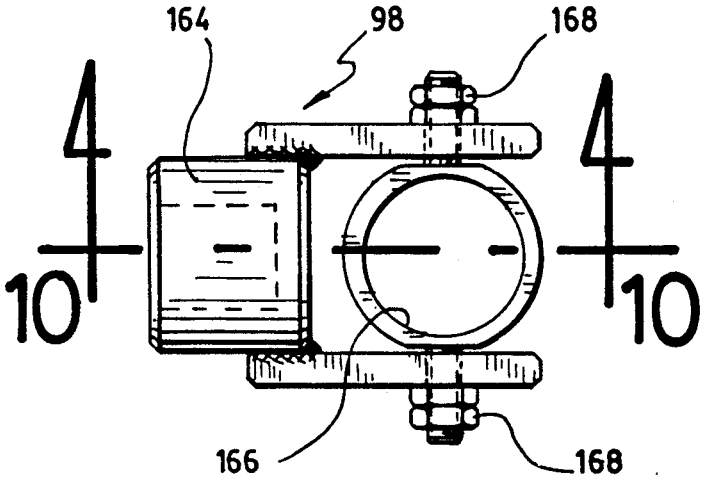
FIG. 9 is a side view of a connecting member between a hydraulic cylinder and a transversal bar.
Figure 15:
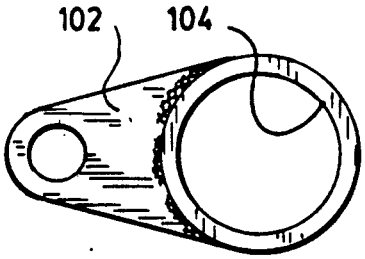
FIG. 15 is a top view of a sleeve member for connecting a chain to the transversal bar.
Figure 10:
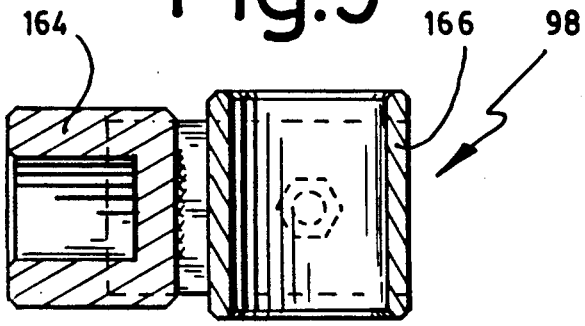
FIG. 10 is a cross-sectional view of taken along line 10—10 of FIG. 9.

FIGS. 9 and 10 show the details of the connection between the piston 90 and transversal bar 84 of FIG. 6. The connecting member 98 is constituted by a pair of sleeves 164 and 166 orthogonally disposed relative to one another. The sleeve 164 is mounted at the end of the cylinder 90 and the sleeve 166 is mounted on the transversal bar 84 which can be tightened by nuts 168.

Perforations such as 170, 172, 174 are also provided in the base plate 22 for allowing the fluid lines such as 84 (FIG. 4) and 94 (FIG. 6) of the cylinders 46 and 90 respectively to have access behind the plate 22 and to reach a fluid reservoir 176 shown in FIG. 2.

This application is simultaneously filed by the same inventor with an application directed to a system for sliding the force applying structure around the vehicle straightening bench.

I claim:

1. A force applying structure adapted to be fixed on the periphery of a frame straightening bench of a vehicle or simultaneously producing a pushing and a pulling action on a part of said vehicle, said structure comprising:

an upstanding post adapted to be rigidly fixed in space relationship with said bench;

a base plate vertically fixed to said post;

a first set of two pairs of partition plates spacedly fixed edgewise on said base plate for forming a vertical channel and a second set of two pairs of partition plates spacedly fixed on said base plate for forming a horizontal channel, the vertical and the horizontal channels intersecting each other for forming a cross-shaped recess therebetween.

a first hydraulic cylinder secured between one of said pairs of partition plates, said cylinder having a piston adapted to project away from the intersection of said channels and in parallel relationship with said base plate, a wheel rotatably mounted on said piston;

a pair of guide members located at the intersection of said channels adjacent said one of said pair of partition plates, said guide members displaying a partly circular contour inside said channels;

anchor means fixed to said partition plates outside said channels;

a second hydraulic cylinder adapted to be removably fixed to anyone of said vertical and horizontal pairs of partition plates for projecting away from said base plate;

at least one pulley adapted to be mounted in anyone of said channels across one of said pairs of partition plates, said pulley being adapted to rotate in the plane of the corresponding channel;

a chain adapted to be anchored to said anchor means, said chain adapted to pass over said wheel, one of said guide members and one of said pulleys, whereby the actuation of both of said cylinders produces a simultaneous pulling action on the chain and a pushing action in a direction substantially perpendicular to the plane of said base plate.

2. A force applying structure as recited in claim 1, wherein the anchor means comprises a hook member secured to said partition plates outside said channels, said hook member having a notch for engaging the chain.

3. A force applying structure as recited in claim 1, wherein said partition plates are provided with perforations, said perforations adapted for selectively mounting said pulley and said second cylinder in anyone of said perforations.

4. A force applying structure as recited in claim 3, comprising a bracket adapted to be connected to said second cylinder and to said chain, said bracket comprising a transversal bar, a pair of sleeve members slidingly mounted on said bar, an abutting arm secured to each of said sleeves whereby each of said arms are adapted to push and pull upon actuation of the chain and the second cylinder.

5. A force applying structure as recited in claim 4 wherein said abutting arms are internally threaded for threadedly engaging vehicle wheel hub nuts.

6. A force applying structure as recited in claim 1, wherein said base plate is slidingly mounted on said post.

7. A force applying structure as recited in claim 4, comprising at least one U-shaped clamp secured to said base plate on the side opposite said partition plates for holding said base plate on said post, said post being cylindrical, a key fixed on said post, a slotted plate secured on said base plate adjacent said clamp, said slotted plate having a slot overlapping said key and wider than the latter, whereby rotation of said clamp and said base plate around said post is angularly restricted by said key.

* * * * *